United States Patent [19]

Rice

[11] 4,065,907

[45] Jan. 3, 1978

[54] DEMOUNTABLE MULTIPLE LEVEL BUILDING STRUCTURES

[75] Inventor: Edward K. Rice, Los Angeles, Calif.

[73] Assignee: Unicon Parking Structures, Inc., Van Nuys, Calif.

[21] Appl. No.: 340,689

[22] Filed: Mar. 13, 1973

Related U.S. Application Data

[62] Division of Ser. No. 93,097, Nov. 27, 1970, abandoned.

[51] Int. Cl.[2] ..... E04B 1/348

[52] U.S. Cl. ..... 52/747; 52/79.11; 52/227; 52/745

[58] Field of Search ..... 52/227, 230, 452, 73, 52/79, 223, 741, 745, 747

[56] References Cited

U.S. PATENT DOCUMENTS

| | | | |
|---|---|---|---|
| 2,101,538 | 12/1937 | Faber | 52/230 |
| 2,483,175 | 9/1949 | Billner | 52/227 |
| 3,089,215 | 5/1963 | Stubbs | 29/452 |
| 3,299,588 | 1/1967 | Arnold | 52/73 |
| 3,432,978 | 3/1969 | Erickson | 52/227 |
| 3,462,908 | 8/1969 | Wysocki | 52/79 |
| 3,464,168 | 9/1969 | Russell | 52/227 |
| 3,619,959 | 11/1971 | Parker | 52/223 |
| 3,640,038 | 2/1972 | Heron | 52/741 |
| 3,676,968 | 7/1972 | Campbell | 52/223 |

FOREIGN PATENT DOCUMENTS

| | | | |
|---|---|---|---|
| 290,175 | 12/1965 | Australia | 52/79 |
| 1,010,724 | 6/1957 | Germany | 52/223 |
| 1,434,793 | 10/1968 | Germany | 52/263 |
| 988,114 | 4/1965 | United Kingdom | 52/236 |
| 893,974 | 4/1962 | United Kingdom | 52/228 |

*Primary Examiner*—Price C. Faw, Jr.
*Assistant Examiner*—Henry Raduazo
*Attorney, Agent, or Firm*—Lyon & Lyon

[57] ABSTRACT

A multiple level building structure utilizing a first set of precast reinforced concrete modules having integral supporting legs separated by a second set of precast or in situ cast reinforced concrete modules, each of the second set of modules being supported along opposite side margins by members of the first set of modules; the structure also including, if desired, a third set of modules of greater width than the first or second set of modules, the modules having tendon guideways therein and being secured together by removable post tensioning tendons strung through the guideways.

2 Claims, 27 Drawing Figures

DEMOUNTABLE MULTIPLE LEVEL BUILDING STRUCTURES

This is a division of application Ser. No. 93,097, filed Nov. 27, 1970 and now abandoned.

BACKGROUND AND SUMMARY OF THE INVENTION

Reference is made to my previous application for a Precast Concrete Building Construction, filed June 2, 1969, Ser. No. 837,986. Disclosed in the previous application is a multiple story structure primarily adapted, but not limited, for use as a parking garage, the structure utilizing a set of precast reinforced concrete units or modules, each comprising a slab and four supporting legs. These are set side-by-side and end-to-end, as well as stacked vertically to form a multistory structure. The units are secured together horizontally and vertically by post tensioning tendons which may, if desired, be released to permit disassembly and removal to another location for reuse. A successful multiple story garage structure has been built in accordance with the disclosure in the previous application.

The present invention is directed to a further development of the previous structure, and is summarized in the following objects:

First, to provide a demountable multiple level building structure wherein a first set of elongated precast concrete modules having supporting legs are so positioned in spaced relation that a second set of precast concrete modules coextensive in length but without supporting legs may be positioned in the space provided between the first set of supporting modules for support thereby.

Second, to provide a multiple level building structure, as indicated in the previous object, wherein the supporting modules may be so spaced as to receive supported modules endwise, or supported modules of extra width, therebetween to provide extra spacing between the legs of adjacent supporting modules; each such extra wide supported module, if its span requires, being provided with tendon chases or guideways of catenary profile contained within the slab itself or extending into underlying beams should the module be so provided.

Third, to provide a demountable multiple level building structure which incorporates a novel means and method whereby the second set of supported modules, whether standard or of extra width, may, if desired, be cast in situ yet are capable of later disassembly, and wherein a supporting form may be used to cast an uppermost module, then lowered to cast the module next below.

Fourth, to provide a demountable multiple level building structure and method of construction wherein, should selected supported modules be cast in situ, the tendons are first threaded through the precast modules and span the spaces to receive in situ cast modules; and, wherein the exposed or spanning portions of the tendons are covered by novel sheaths which, after the modules are in situ cast therearound, permit sliding movement of the tendons for tensioning, as well as subsequent removal should this be desired.

Fifth, to provide a demountable multiple level building structure, as indicated in the preceding objects, wherein selected modules of the second or supported set may be provided at their ends with novelly arranged extensions and recesses for effecting end-to-end connections and mating transversely extending chases or guideways for receiving post tensioning tendons inserted after assembly to tie the modules in their end-to-end relation.

Sixth, to provide a novel means and method of forming tendon guideways or chases in precast concrete modules wherein an elastically yieldable metal core member of predetermined longitudinal profile is covered with an elastomeric sleeve, is then positioned in the form used to cast the module and finally, after the module has sufficiently cured, the core is first extracted, the core being sufficiently yieldable elastically to permit this operation, whereupon the elastomeric sleeve is readily extracted.

Seventh, to provide a multiple level building structure and method of construction, wherein the supporting modules are provided with vertical tendon guideways formed in the legs and overlying slab portions thereof, corresponding guideways of a stacked set of supporting modules being disposed in vertical alignment to receive a common tendon.

Eighth, to provide a structure, as indicated in the preceding object, wherein the vertical tendons apply a compressive force on the supporting modules having a component which increases the load carrying capacity of the beam of each supporting module extending between the legs thereof.

Ninth, to provide a structure, as indicated in the other objects, wherein the mutual engaging surfaces of the supporting and supported modules are secured in fixed mutually bearing relation by the vertical and horizontal tendons so that the modules react to loads as a single unit.

Tenth, to provide a multiple level building structure having novel marginal precast concrete spandrels arranged for ready installation and providing a partial form for casting in situ a marginal walkway.

The demountable multiple level building structure is particularly adapted for use, but is not limited to use, as a multiple level parking structure, and the following description is directed to such structure.

The structure comprises a set of supporting modules 1, a set of supported modules 2 of similar dimension, and a set of major supported modules 3 of greater width than the other modules 1 and 2.

Figures 7, 8, 9, 10, 11, 12:
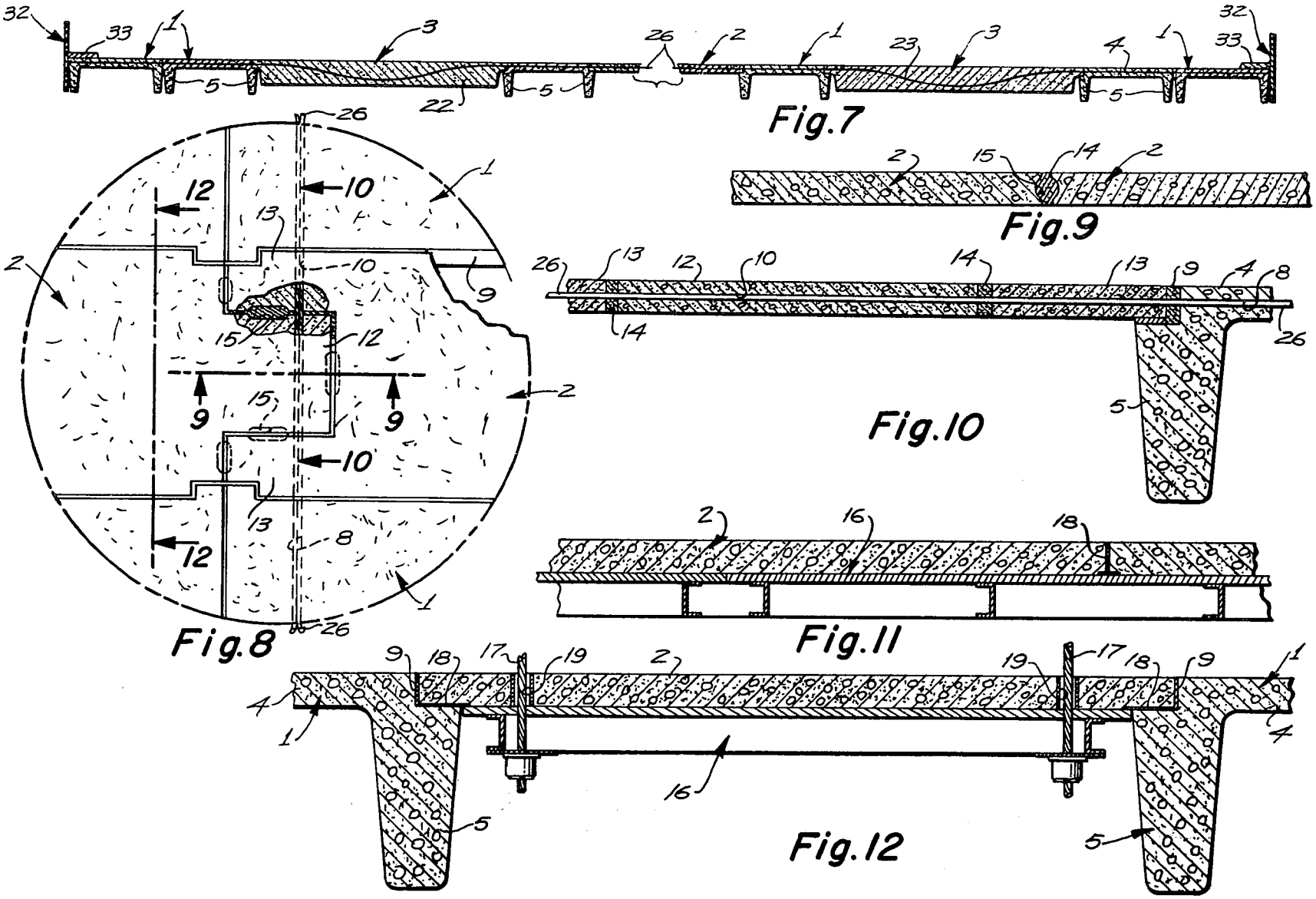
FIG. 7 is an enlarged fragmentary transverse sectional view, taken through 7—7 of FIG. 1.
FIG. 8 is an enlarged plan view, with portions in section, taken within Circle 8 of FIG. 1.
FIG. 9 is an enlarged fragmentary sectional view, taken through 9—9 of FIG. 8, showing a pair of precast supported units in end-to-end relation.
FIG. 10 is an enlarged fragmentary sectional view, taken through 10—10 of FIG. 8.
FIG. 11 is an enlarged fragmentary sectional view, corresponding to FIG. 9, illustrating the manner in which a supported unit may be cast in situ.
FIG. 12 is an enlarged fragmentary sectional view, corresponding to FIG. 8, also showing the manner in which a supported unit may be cast in situ.
Figure 13:
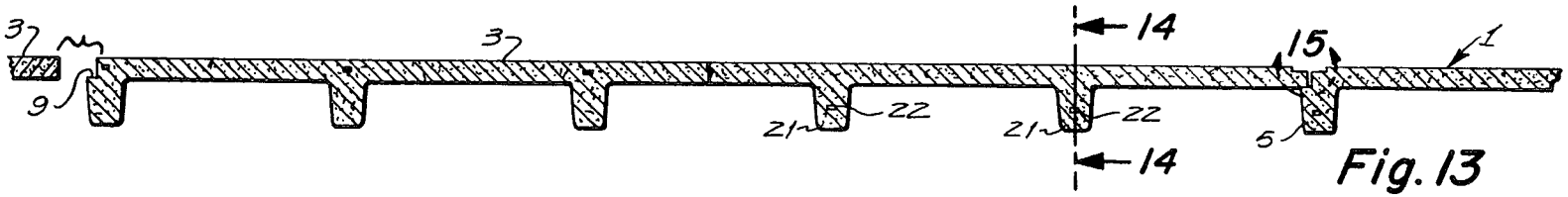
FIG. 13 is an enlarged fragmentary sectional view, taken through 13—13 of FIG. 1, showing particularly a major supported module intended to form or overlie a vehicle passageway.
Figure 14:
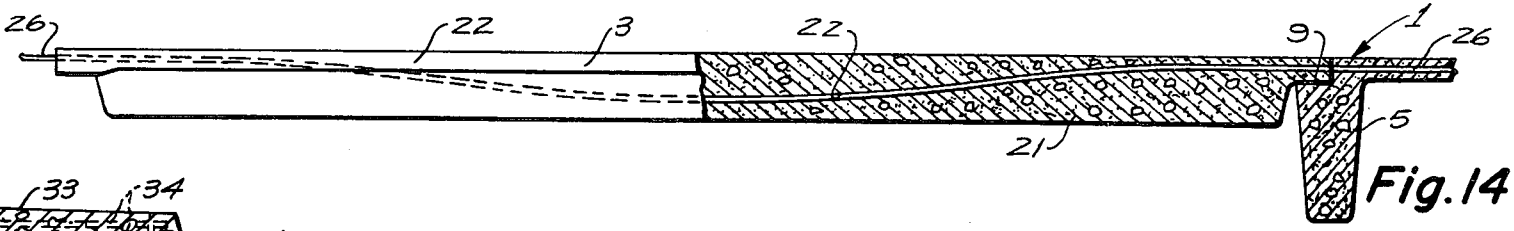
FIG. 14 is a fragmentary transverse sectional view, taken through 14—14 of FIG. 13, with portions in elevation.

Each supporting module 1 includes a slab or deck member 4, having longitudinal beams 5 at opposite sides thereof, and transverse beams 6 at the ends thereof. A leg 7 extends downwardly from each end of the longitudinal beams 5. The slab member 4 is provided with transverse tendon chases 8 (FIG. 10). Formed above each longitudinal beam 5, preferably terminating a short distance from the ends thereof, are side shoulders 9, having a depth approximately equal to the depth of the slab or deck member 4.

Each supported module 2 is in itself a slab or deck member and is provided with transverse tendon chases 10. Each supported module 2 is dimensioned to fit between a pair of supporting modules 1, with its margins resting on the side shoulders 9. If needed, mounting shims 11 are interposed to bring the surface of the supported module into coplanar relation to the slab member 4 of the adjacent supporting modules 1. As will be brought out hereinafter, the supporting modules 1 may be arranged in rows, providing space therebetween for the supported modules 2. If the area of one or more of the levels comprising the structure warrant, some of the supported modules 2 may be tied in end-to-end relation. This is done by providing an end extension 12 on selected modules which fit within corresponding end recesses 13 of other modules. Space is provided around the end extensions 12 and around the periphery of the supported module 2 for the purpose of receiving grouting 14. If desired, keying recesses 15 may be provided particularly at the sides of the end extensions and the corresponding walls of the end recesses. A tendon chase 10 extends transversely through each end extension 12 and through the portions of the companion module bordering its end recess 13.

The supported modules 2 may instead of being precast, be cast in situ. In this case, a bottom form 16 (FIGS. 11 and 12) is provided, the side margins of which abut the margins of adjacent supporting modules 1 and may be held in such position by suspension cables 17. The margin of the area in which the slab or supported module 2 is to be cast is aligned with appropriate parting elements 18, suitable coated with a parting agent, or the elements may be omitted and merely a parting agent applied. Also, sleeves 19 are placed around the suspension cables 17.

If this procedure is employed, the supported modules are formed after the supporting modules have been stacked so that the uppermost supported module 2 may be cast, then the form lowered to the next level and the casting operation repeated. This procedure is further repeated until all of the supported modules have been cast.

Figure 27:
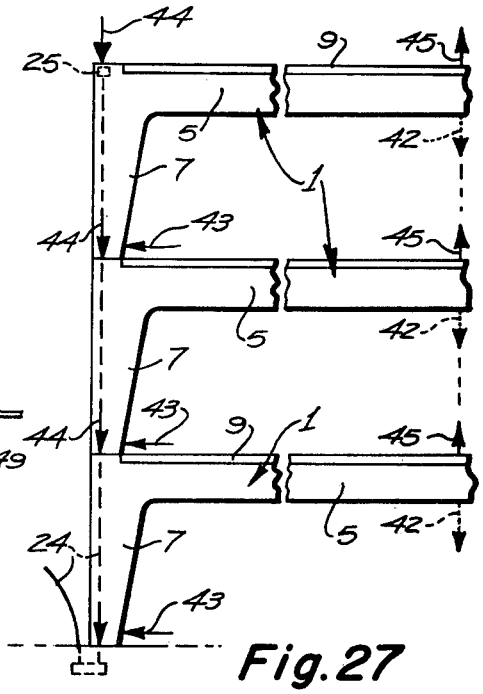
FIG. 27 is a fragmentary substantially diagrammatical view, indicating the manner in which the vertical tendons contribute force resisting loads on the beams spanning between the ends of supporting modules.

Each major supported module 3 includes a slab or deck member 20 of substantially greater width than the supporting or supported modules 1 and 2, and, if the width of the modules 3 warrants, they may be provided with transverse beams 21. Formed in the beams are tendon chases 22, each having a catenary profile (see FIG. 7). The multiple level parking structure is assembled as follows:

After forming appropriate foundation and a ground level deck of concrete, not shown, the supporting modules are arranged in rows. Secured in the foundation by conventional anchors 23 (FIG. 3) are vertical tendons 24, as indicated in FIG. 27, and further illustrated in my copending application. These tendons, which, per se, are conventional, are threaded upwardly through appropriate vertical chases or guideways 24a (FIG. 4) formed in the legs 7, and also illustrated in the copending application, and are provided with conventional anchors 25.

The spaces between the rows of supporting modules 1 are approximately equal to the width of the supported modules; that is, dimensioned to receive a row of supported modules 2, with the lateral margins thereof resting on the side shoulders 9. Alternatively, the supported modules 2 may be cast in situ between pairs of supporting modules 1 and utilizing a bottom form 16, as indicated in FIGS. 11 and 12. In either case, the alternate rows of supporting modules 1 and supported modules 2 cover the parking area below and form an additional or upper parking area. The length of the supporting modules and supported modules is preferably such to provide two rows of parking stalls with an access passage therebetween.

In order to provide automobile passageways between the rows of parking stalls, the major supported modules 3 are used and are located at opposite ends of the rows of parking stalls. It has been found convenient to make the major supported modules 3 about three times the width of the modules 1 and 2. However, in order to facilitate handling the major supported modules 3 if these modules are precast, the length of the major supported modules is less than the modules 1 and 2. This is also true if the major supported modules 3 are cast in situ.

When the modules 1, 2 and 3 are assembled, their respective tendon chases or guideways 8, 10 and 22 are disposed in alignment so that horizontal post tensioning tendons 26 may be threaded therethrough. The tendons may go from one side of the structure to the other or through any predetermined number of modules. The tendons 26, per se, are conventional and are joined to conventional fixed anchors and tensioning anchors, not shown, located at the extreme sides of the assembled modules 1, 2 and 3, or at appropriate intermediate points. These anchors function in the manner of the anchors 22 and 24, as indicated in connection with the vertical tendons 23. For example, the anchors may be similar to those shown in U.S. Pat. No. 3,293,811 and U.S. Pat. No. 3,408,783.

As each supporting module is lowered into position, spacer pads, preferably of metal, are placed under each leg. Later, the remaining space is filled with grout. Also, after the horizontal tendons are in place, grout is filled in the spaces, if any, between adjacent modules in order that bearing contact between adjacent modules occupy at least a large percentage, if not all, of their confronting edges.

In both cases, the grout is preferably of a type which does not shrink and is capable of withstanding crushing loads without compressing. Some plastic materials may be used. Also, Portland cement containing an expansion agent in a quantity to compensate for shrinkage may be used.

When the vertical tendons are tensioned, the legs and the confronting surfaces of the module or foundation slab below are pressed together with sufficient force that relative movement is prevented and the stack of modules behaves as a unit. Similarly, when the horizontal tendons are tensioned, the confronting edges of the modules are pressed together with sufficient force that relative movement is prevented and thus the horizontal structure formed by the modules behaves as a unit. That is, loads applied to one module are transmitted in part to all adjacent modules, both vertically and horizontally. The only exception occurs where expansion joints are interposed.

Figure 15:
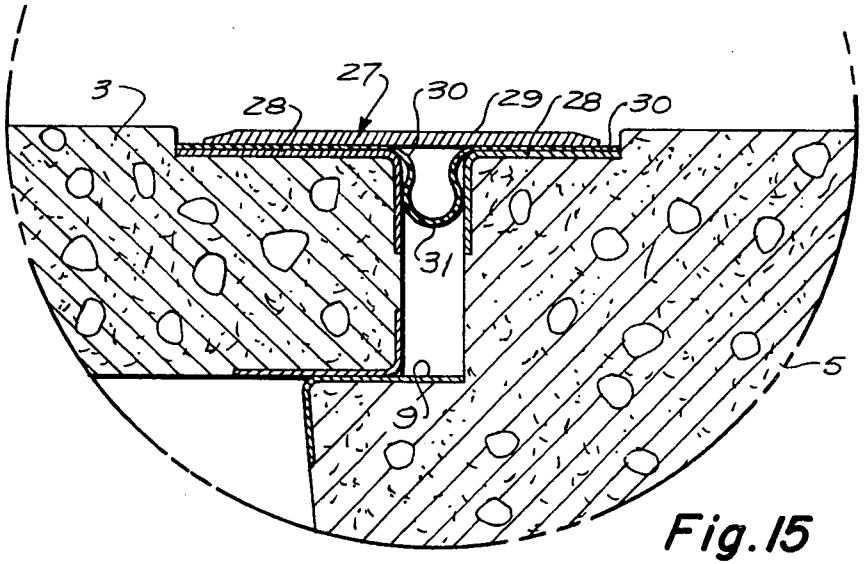
FIG. 15 is a further enlarged fragmentary sectional view, taken within Circle 15 of FIG. 13.
Figure 16:
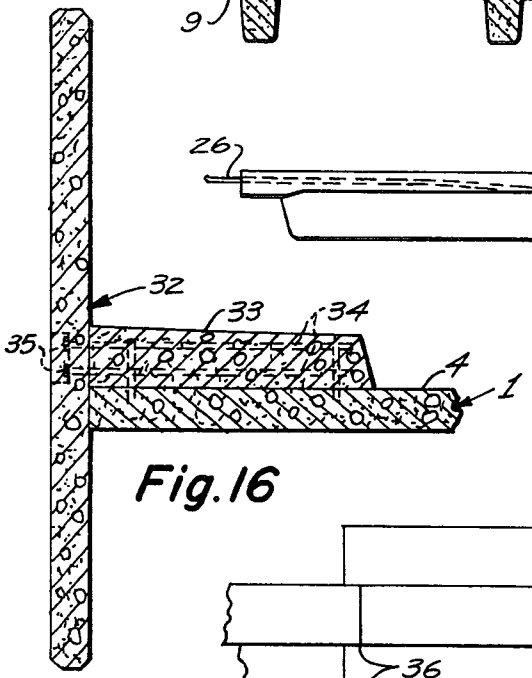
FIG. 16 is an enlarged fragmentary sectional view, taken through 16—16 of FIG. 1, showing the spandrel and adjacent walkway.

If the size of the parking structure requires, appropriate sections thereof are divided by expansion joints 27, such as shown in FIG. 15. The expansion joints are located between the modules and include L-shaped boundary strips 28 recessed slightly below the normal level of the modules to provide space for a cover strip or plate 29. In addition, a sealing strip 30 of low friction plastic material may underlie the cover plate 29 and be provided with a loop 31 to permit expansion and contraction.

In the construction illustrated, two modules are arranged end-to-end between expansion joints 27 and the end extensions 12 and end recesses 13 are located between the pairs of supported modules 2. It will be noted that the post tensioning tendons 26 are threaded through the end extensions and the side margins of the companion module at opposite sides of the end extensions so that the supported modules are locked against longitudinal separation.

Figure 3:
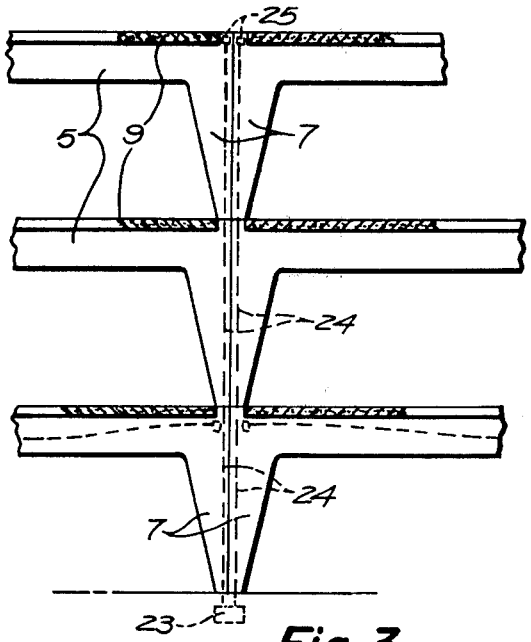
FIG. 3 is a fragmentary side elevational view of the stacked modules, taken in the direction of 3—3 of FIG. 2.
Figure 5:
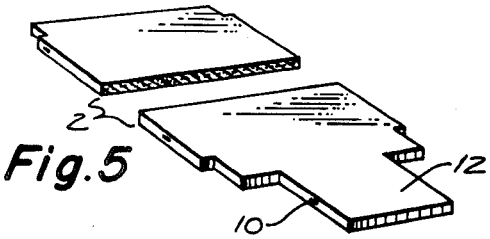
FIG. 5 is a fragmentary perspective view of a supported module.
Figure 4:
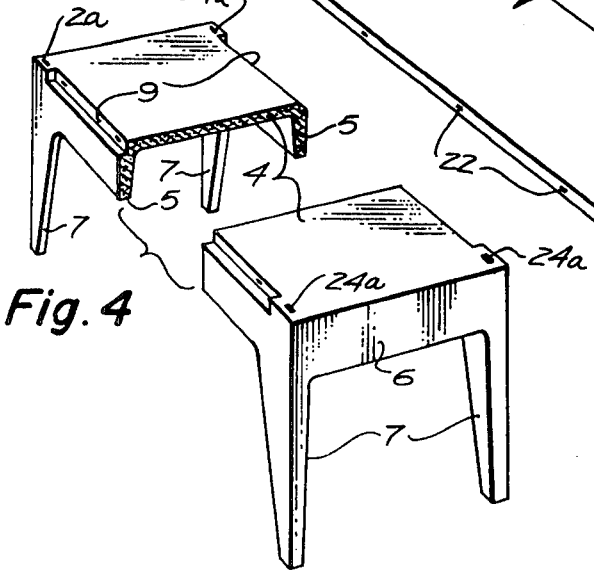
FIG. 4 is a fragmentary perspective view of the supporting module.
Figure 6:
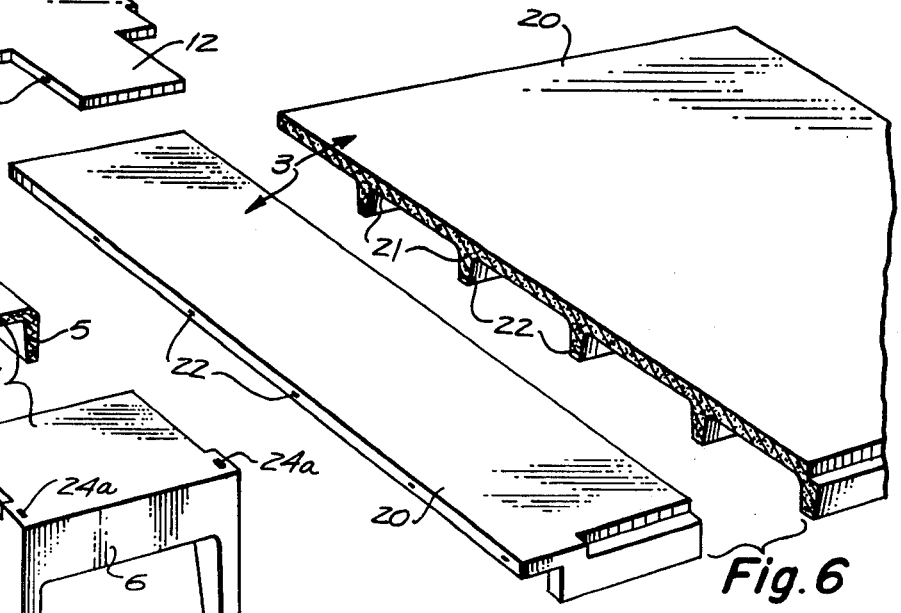
FIG. 6 is a fragmentary perspective view of an expanded or enlarged supported module.

It should be noted that all of the modules are provided with conventional internal reinforcing and the longitudinal beams of the supporting modules 1 may be provided with catenary chases or guideways to receive conventional post tensioning tendons, as suggested in FIG. 3.

Each elevated deck of the parking structure is bordered by precast spandrels 32 and an adjacent walkway 33, which is cast in situ. This is preferably accomplished by extending portions of the reinforcing contained in the modules upwardly for connection to walkway reinforcing 34. The reinforcing 34 may include screwthreaded portions 35 so located that the spandrels may be secured thereto prior to casting the walkway 33 so that the spandrels provide permanent edge forms for the walkway, which is cast after the spandrels have been positioned.

Figure 17:
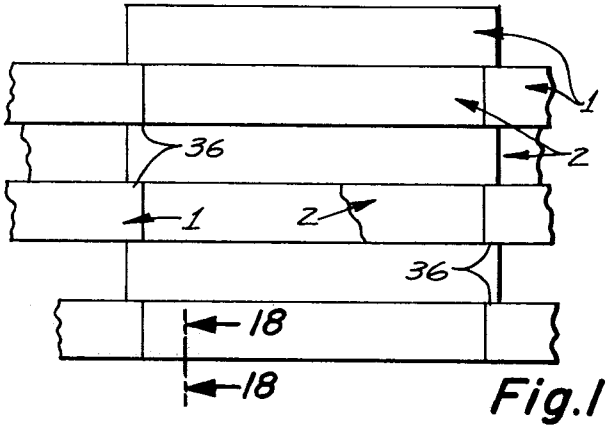
FIG. 17 is a fragmentary substantially diagrammatical plan view, showing a modified arrangement of the supporting modules and supported modules.
Figure 18:
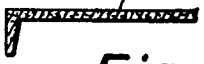
FIG. 18 is an enlarged fragmentary sectional view, taken through 18—18 of FIG. 17.
Figure 19:
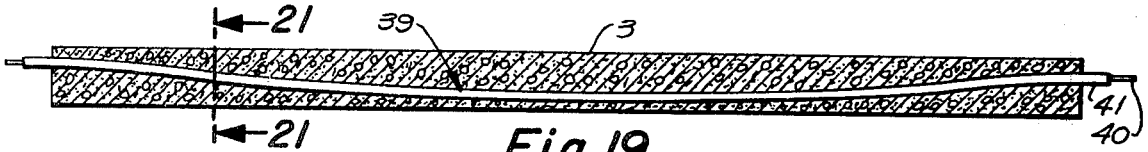
FIG. 19 is a sectional view of a typical precast slab, showing a guideway casting sleeve structure.
Figure 20:
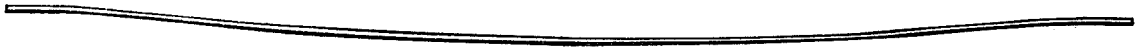
FIG. 20 is a side view of the core member employed in the guideway casting sleeve.
Figure 21:
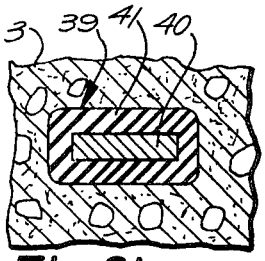
FIG. 21 is an enlarged fragmentary sectional view, taken through 21—21 of FIG. 19, showing the guideway casting sleeve in place.
Figure 22:
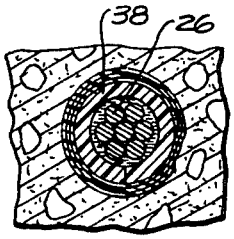
FIG. 22 is a sectional view, corresponding to FIG. 21, showing a tendon and surrounding casting sheath as employed in the in situ casting of a slab.

While it is preferred to arrange the supporting modules 1 in rows, it should be noted that, as indicated in FIGS. 17 and 18, the supporting modules 1 may be arranged in an elongated checkered pattern with their ends overlapping, as indicated by 36. In this case, the supported modules 2 are shorter than the supporting modules 1 to the extent that the supporting modules overlap at their ends. As in the first described structure, the supported modules may be precast or cast in situ.

While the tendon guideways 8 and 10 may be straight and confined within the relatively thindeck slabs, they may also, within the limits of the slabs, have catenary profiles. The corresponding guideways 22 in the major supporting modules 3 which are located in the beams 21 have an increased catenary profile. As a consequence, when the tendons are placed under tension, the catenary portions of the tendons provide an upward supporting force as well as a tying force holding the modules together as a unit.

Figure 1:
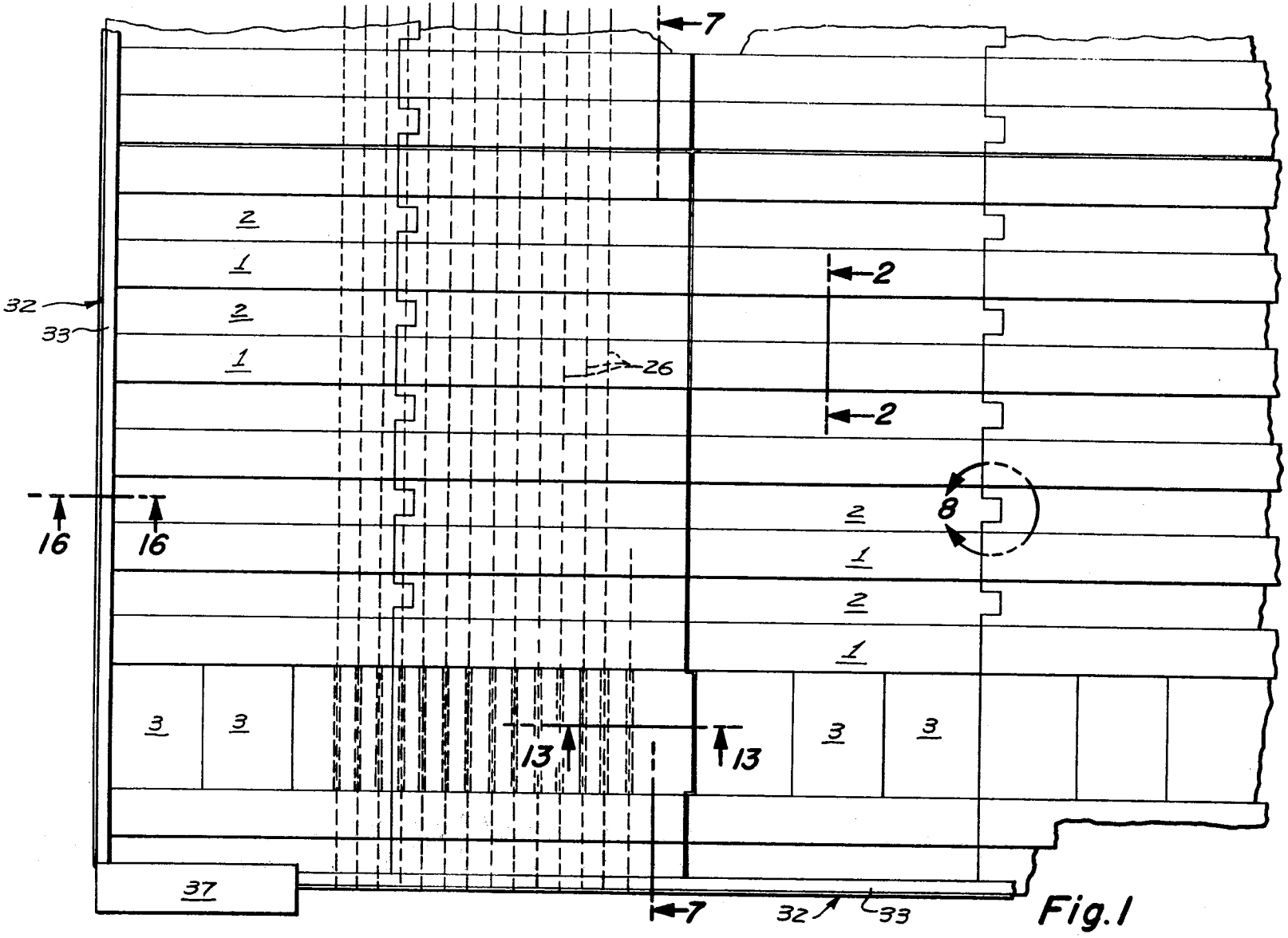
FIG. 1 is a substantially diagrammatical fragmentary plan view of the building structure incorporating the invention.
Figure 2:
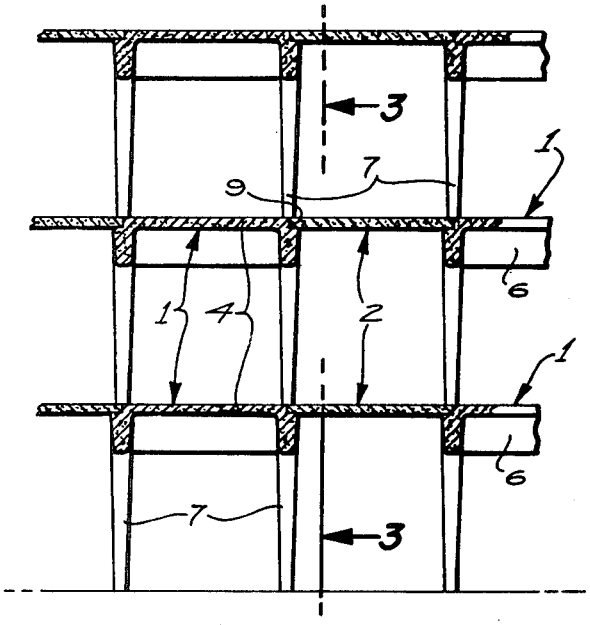
FIG. 2 is an enlarged fragmentary sectional view, taken through 2—2 of FIG. 1, indicating the manner in which the modules forming the structure are stacked to form a multiple level structure.
Figure 26:
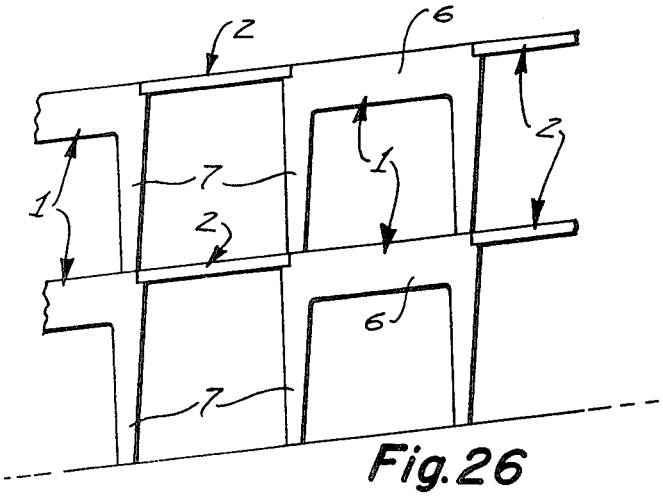
FIG. 26 is a fragmentary substantially diagrammatical view, corresponding to FIG. 2, showing several modules modified to form a ramp or an inclined parking deck.

Communication between the different levels is by means of ramps which may utilize the supported modules 2 or 3 and modules similar to the supporting modules 1 except that the legs are angularly related to the slab to place the slab on an incline, as indicated in FIG. 26. In many cases, it is desirable to utilize two parking areas inclined in opposite directions and serially connected by the passageways formed by the modules 3. Wherever needed, preferably attached to the outside of the structure are elevator enclosures and stairway enclosures, indicated by 37 in FIG. 1.

If the modules 2 or 3 are cast in situ, the horizontal tendons 26 are first threaded through the precast modules and the portions thereof spanning the spaces in which the other modules are to be cast are covered by a sleeve or sheath 38. Each sleeve may be a plastic tube slipped over the tendon as the tendon is passed between spaced precast modules or may comprise a lineally or spirally split sleeve wrapped with sealing tape.

In either case, a lubricant is placed around the tendon. If the building structure is intended to be permanent, the clearance between the tendon and its sleeve may be merely sufficient to permit initial tensioning, as in the case of conventional post tensioning practice. If the structure is intended to be demountable, the clearance as well as the thickness of the sleeve is such as to ensure subsequent withdrawal of the tendon.

With regard to the extra wide module 3, building fire codes concerning slab thickness are such that in many cases, the beams 21 may be omitted, yet, the thickness may be sufficient to permit a satisfactory catenary profile in the tendon guideway.

Whether the chases or guideways in the precast modules are straight or of catenary profile, they are formed by use of a casting sleeve 39, comprising a core 40 and sheath 41. If the chase or guideway is of catenary profile, the core is formed of steel, preferably spring steel, formed to the desired profile. The sheath is molded of soft rubber or other material having similar properties. The elastic properties of the steel core permit its withdrawal, after the module is cast and set, without permanent deformation. Once the core is removed, tension applied to the sheath, progressively breaks it away from the guideway wall.

As in the case in my previous application, Ser. No. 873,986, the vertical tendons, on being tensioned, increase the load carrying capacity of the beam spanning between pairs of vertical tendons. More specifically, referring to FIG. 27, a downward load represented by the arrows 42 at the center of the beams produces an outward force on the lower extremities of the legs, as indicated by the arrows 43. When the vertical tendon is placed under tension a downward force, as represented by the arrows 44, binds the members of each stack of modules together and compresses the legs, particularly the region immediately surrounding the tendon as compared to the region inwardly thereof or toward the center of the beam. This compression actually produces a turning couple to the extent that a resulting upward force is obtained at the center of the beam, as represented by the arrows 45.

This can be observed during the assembly of a stack of supporting modules. During assembly and prior to tensioning the vertical tendons, it is customary to place jacks or the like between the central portions of the beams to prevent undue sagging. When the vertical tendons are tensioned, the central portions of the beams lift sufficiently that the jacks become loose.

Figure 23:
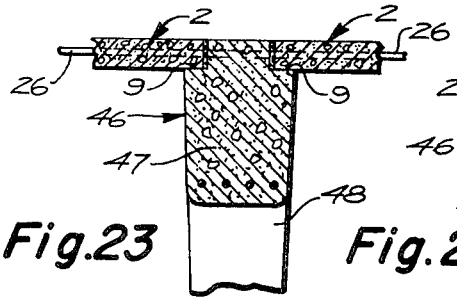
FIG. 23 is a fragmentary transverse sectional view, showing a modified supporting module comprising a beam and end legs and a pair of supported modules in place at opposite sides thereof.
Figure 24:
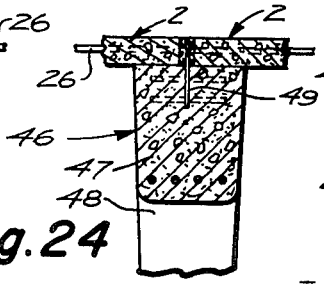
FIG. 24 is a fragmentary sectional view, corresponding to FIG. 23, showing a modified means of connection between the supporting and supported modules.

Reference is directed to FIG. 23 which illustrates fragmentarily a modified supporting module 46, comprising a beam 47, corresponding to a beam 5 and a pair of legs 48, one at each end, and corresponding to a leg 7. Opposite sides of the beam 47 are provided with ledges 9 to receive the side margins of supported modules 2 or 3. Tendon guideways extend through the intervening upper portion of the beam 47. Alternatively, as indicated in FIG. 24, the beam 47 may be provided with vertical anchoring plates 49 or other reinforcing, disposed between adjacent supported modules. The horizontal tendons 26 may extend through or at one side of such plates or reinforcing. The space between the modules is filled with grout encasing the protruding portions of the anchor plates 49.

Figure 25:
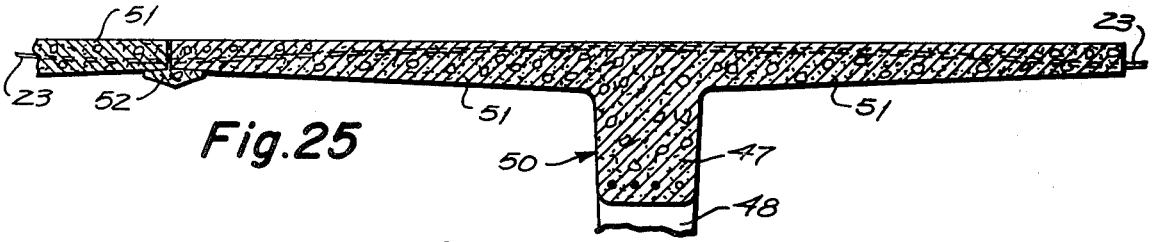
FIG. 25 is a transverse sectional view, showing a further modified supporting module of T-shaped cross section.

Reference is made to FIG. 25, which illustrates a further modified supporting module 50, having a single beam 47 and a pair of legs 48, as shown in FIGS. 23 and 24. In this case, however, the lateral sides of the beam 47 are provided with cantilever extensions 51. The modules 50 may be positioned with the extensions 51 in edge-to-edge relation. If desired, a ledge 52 may be provided to aid in aligning an adjacent extension. Also, the modules 50 may be spaced to receive supported modules 2 or 3, in which case a ledge 52 is provided on both extensions or the legs 48 may be omitted from the alternate modules to form supported modules. Still further, the modules 50 may be set in end-to-end relation in the manner of the modules 1 and 2; that is, alternate modules 50 may be constructed without the legs 48 and arranged to rest with their ends on other modules having legs.

If the modules 1 and 2, and also module 50, are dimensioned within the size (usually in the order of nine to twelve feet wide and up to sixty feet long) which may be transported by truck, a central manufacturing plant may be established and the modules trucked to the point of use. If the modules 3 are set crosswise, they may be similarly dimensioned for transportation. Often, because they are essentially flat slabs, it is feasible to precast modules 2 and 3 on or near the job site in which case they are cast each on top of preceding modules.

While particular embodiments of this invention have been shown and described, it is not intended to limit the same to the details of the constructions set forth, but instead, the invention embraces such changes, modifications and equivalents of the various parts and their relationships as come within the purview of the appended claims.

I claim:

1. A method of constructing a building structure, characterized by:

a. precasting supporting modules, each having transverse guideways;
b. positioning the supporting modules in predetermined spaced and coplanar relation;
c. stacking similarly positioned supporting modules thereon to form a multiple level structure;
d. extending tendons through the guideways and between the supporting modules of an upper level;
e. placing a casting form to extend between spaced supporting modules at said upper level;
f. casting a supported slab in the form and around the portions of tendons extending between the supporting modules;
g. lowering the casting form to a lower position at the level of a lower pair of spaced supporting modules while having said cast slab supported at said upper level;
h. extending tendons through the guideways and between the supporting modules at the lower level;
i. casting a further supported slab, in said casting form and repeating said step of lowering said casting form and repeating said step of lowering said casting form;
j. and after completion of each level tensioning, the tendons exert transverse compression loads in the supporting and supported modules.

2. A method as defined in claim 1, wherein said casting form is suspended by cables and the supported slabs are cast about the cables, characterized by:

a. sliding the cables through any previously cast supported slab as the form is lowered to a lower casting position.

* * * * *